United States Patent [19]

Gustafson

[11] 4,419,070

[45] Dec. 6, 1983

[54] DECORATIVE MOLTEN WAX DISPLAY

[75] Inventor: Alexander Z. Gustafson, Chicago, Ill.

[73] Assignee: Chicago Digital Incorporated, Chicago, Ill.

[21] Appl. No.: 250,419

[22] Filed: Apr. 2, 1981

[51] Int. Cl.[3] ..... F21Q 3/00; F23Q 2/32

[52] U.S. Cl. ..... 431/126; 116/202; 431/288

[58] Field of Search ..... 116/202; 431/126, 288, 431/289

[56] References Cited

U.S. PATENT DOCUMENTS

| | | | |
|---|---|---|---|
| 2,504,211 | 4/1950 | Means | 431/126 |
| 2,541,725 | 2/1951 | Sundell | 431/126 |
| 2,720,099 | 10/1955 | Gronowski | 431/126 X |
| 2,959,950 | 11/1960 | Weglin | 431/126 |
| 3,266,272 | 8/1966 | Fredericks | 431/126 |
| 3,283,546 | 11/1966 | Matsui | 431/288 X |
| 3,287,484 | 11/1966 | Justus | 431/126 X |
| 3,536,029 | 10/1970 | Kuwayama et al. | 116/202 |

FOREIGN PATENT DOCUMENTS

| | | | |
|---|---|---|---|
| 458124 | 10/1913 | France | 431/288 |

*Primary Examiner*—Daniel M. Yasich

*Attorney, Agent, or Firm*—Burmeister, York, Palmatier, Hamby & Jones

[57] ABSTRACT

A method of producing a decorative movement of metal particle display in a pool of molten wax of a burning candle. Portions of a wax crayon containing colored metallic particles different from the color of the candle wax is melted in the flame of the candle and directed to fall into the molten pool for observation.

4 Claims, 1 Drawing Figure

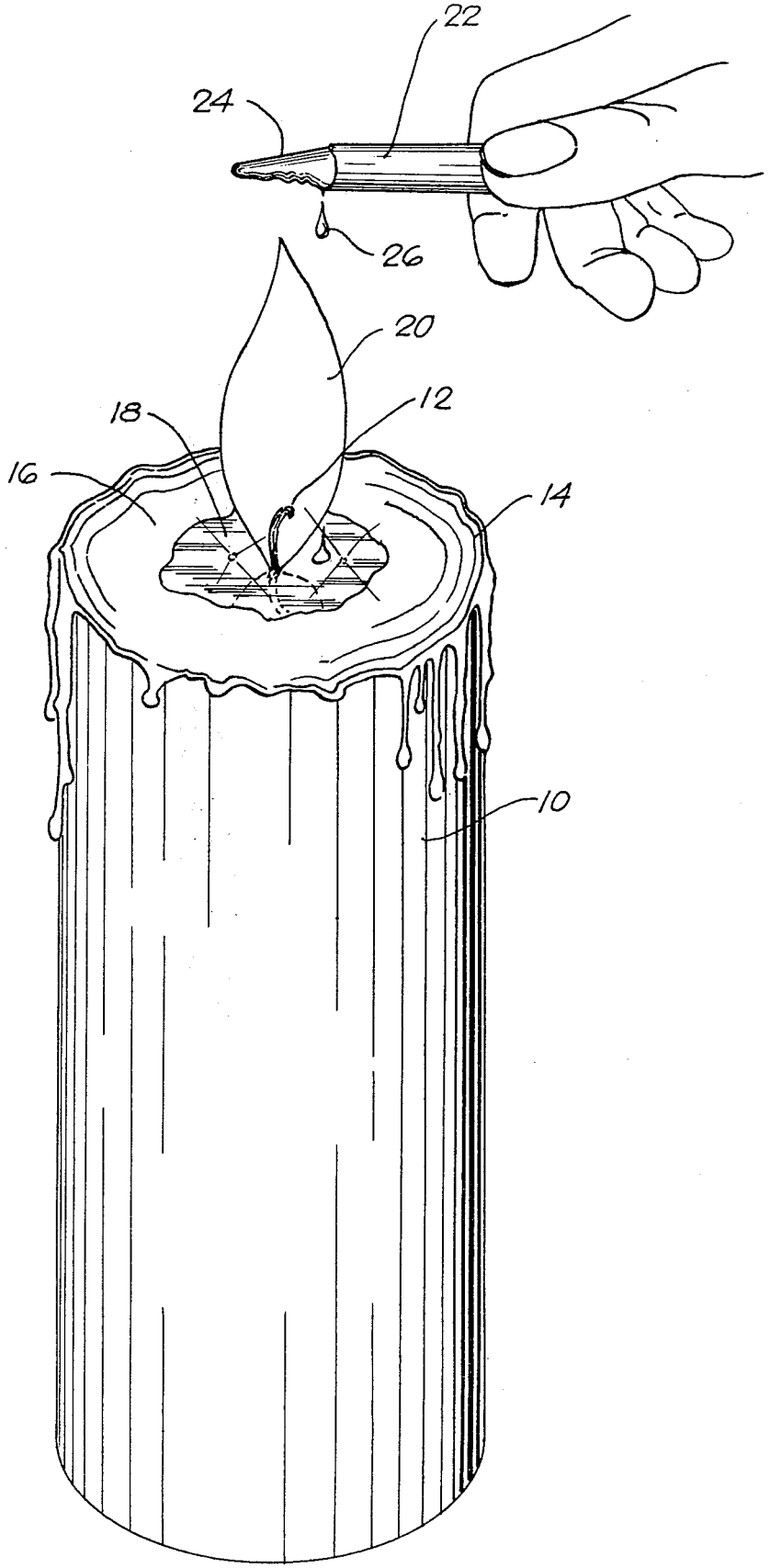
22
24
26
20
12
18
16
14
10

DECORATIVE MOLTEN WAX DISPLAY

The present invention relates to methods for producing decorative effects with candles and to methods of observing the process of a burning candle.

Candles were used in ancient times as a source of light, and more recently as a decorative light source. In addition to its conventional properties, the color of the flame of a candle has been intentionally changed for decorative purposes, as taught by Matsui in U.S. Pat. No. 3,283,546 entitled CANDLE IMPREGNATED WITH FLAME-COLORING AGENTS. In addition, Weglin U.S. Pat. No. 2,959,950 and Means U.S. Pat. No. 2,504,211 are patents in which the color of the flame is changed.

The present invention is however directed to producing desirable color areas or regions in the molten pool of a burning candle. In addition, the present invention is directed toward providing particles in the pool of a burning candle to enable the currents within that pool to be visually observed.

The present invention is also directed to the use of a candle as an artistic tool to permit a person to achieve color bands and distributions in the molten pool of a burning candle within his range of experimentation.

The inventor has achieved the foregoing objects by providing a candle with a wick which may be ignited to form a pool of molten wax of the candle about the wick. A wax crayon containing metal particles of a color different than the wax of the candle is melted in the flame of the candle to form drops of crayon wax and metal particles which fall into the pool of the candle and circulate with the currents of the candle.

The present invention is more thoroughly described with reference to the drawing, in which the single FIGURE is an isometric view of a burning candle in the process of melting a crayon.

The drawing illustrates a cylindrical candle 10 provided with a central wick 12. The candle 10 need not be cylindrical, and need not be elongated as illustrated. The wick 12 protrudes from an end of the candle in which the perimeter of the candle 14 is disposed in a horizontal plane normal to the axis of the candle, and the region 16 of the end of the candle adjacent to the perimeter 14 recesses inwardly to a generally circular pool 18 of molten wax. The pool 18 is formed by the heat of a flame 20 produced by the burning wick 12. The flame 20 is sustained by igniting wax impregnated in the wick 12, the wax being impregnated from the pool 18.

In the normal operation of the candle, wax of the candle flows along the bottom of the pool toward the wick, and rises adjacent to the wick. The reason for this circulation is that the burning wick produces heat which causes the wax to flow upwardly in the pool. The pressure of the rising wax along the exterior surfaces of the wick cause the wax on the surface of the pool to flow outwardly toward the perimeter of the pool. The wax from the pool impregnates the wick and maintains it burning, and the wax of the candle is continuously melted to add molten wax to the pool and replace the wax burned by the flame. Accordingly, a condition of stability results in which the pool achieves a fixed diameter and maintains constant circulation as described above.

The color of the pool is the color of the wax of the candle 20. The candle 20 should consist of wax of a given color so that the pool will maintain a uniform color.

The figure shows a crayon 22 with a conical tapered end 24 positioned closely adjacent to and over the flame 20. The hot vapors and gases from the flame 20 rise, and the conical end 24 of the crayon is therefore subjected to these hot gases and will be heated to a temperature above the melting point of the wax in the crayon 22. The crayon contains particles in addition to wax, and these particles will not melt at the temperature of the flame, will not ignite at the temperature of the flame, and are not dissolvable in the wax of the crayon or the candle. Accordingly, the heat from the flame 20 causes drops designated 26 to be formed, the drops 26 containing molten wax of the crayon and particles of the crayon. The drops 26 are released from the crayon directly over the pool, and by force of gravity fall into the pool 18.

The drops entering the pool 18 release the particles of the crayon into the pool, the wax of the crayon becoming distributed and intermingled with the wax of the pool. The wax of the crayon 22 may be of a different color than the wax of the candle 10, but if this is the case, the color of the pool will shortly become a uniform color of the mixture of the waxes of the pool and of the drops of the candle.

The particles from the candle are preferably metallic particles. The inventor has found that copper particles, aluminum particles and gold particles are particularly desirable. Such metallic particles are very small in size and will circulate with the currents in the pool, rather than falling to the bottom of the pool and remaining fixed in position. The circulating particles constitute a very small volume of the total volume of the circulating pool 18, the wax being a very large volume percentage of this pool. Accordingly, the particles concentrate in the currents within the pool and may be visually observed. By observing the flow of particles in the pool 18, it is possible to determine that the circulation within the pool is along the bottom of the pool toward the wick, thence upwardly along the axis of the wick to the surface of the pool, thence radially outwardly toward the perimeter of the pool, and thence downwardly along the bottom to repeat the cycle. The circulating particles are of a different color than the wax of the pool, and accordingly form attractive patterns or regions of color within the pool.

Crayons are readily available with metal particles of aluminum, copper and gold. Hence, one may experiment with different colors in the wax of a particular color of a particular candle, and may even experiment with different crayons producing different color particles in the same pool at the same time.

Those skilled in the art will readily devise modifications and uses for the present invention beyond those here set forth. It is therefore intended that the scope of the present invention be limited only by the appended claims.

The invention claimed is:

1. The method of producing a decorative molten wax display comprising the steps of igniting a wick to burn the wax in a wax impregnated wick of a candle to produce a flame, said candle having the wick surrounded by a mass including wax of a particular color, said mass having an upper substantially horizontal surface extending a distance of at least $\frac{3}{8}$ inch from the wick to the perimeter of the surface, establishing a pool of molten wax in the surface about the wick of the burning candle, said pool extending from the wick and being spaced from the perimeter of the surface, melting a portion of a wax crayon containing metallic particles of a color different than the color of the wax of the candle in the flame of the candle to produce drops containing molten wax of the crayon and particles of the crayon, and directing the drops from the crayon into the pool of the candle to release the metallic particles from the drops into the pool, and observing the movement of the particles in the pool so as to determine the path of currents of molten wax in the pool, said path of currents forming decorative color patterns for observation at the same time.

2. The method of producing a decorative molten wax display comprising the steps of claim 1 wherein the step of melting the wax crayon produces drops containing particles of aluminum.

3. The method of producing a decorative molten wax display comprising the steps of claim 1 wherein the step of melting the wax crayon produces drops containing particles of gold.

4. The method of producing a decorative molten wax display comprising the steps of claim 1 wherein the step of melting the wax crayon produces drops containing particles of copper.

* * * * *